US009284875B2

(12) United States Patent
Williams et al.

(10) Patent No.: US 9,284,875 B2
(45) Date of Patent: Mar. 15, 2016

(54) OIL-COOLED CYLINDER BLOCK WITH WATER-COOLED BRIDGE

(71) Applicant: Ford Global Technologies, LLC, Dearborn, MI (US)

(72) Inventors: Rick L. Williams, Canton, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/303,519

(22) Filed: Jun. 12, 2014

(65) Prior Publication Data

US 2015/0361862 A1 Dec. 17, 2015

(51) Int. Cl.
*F01P 3/02* (2006.01)
*F01P 3/00* (2006.01)

(52) U.S. Cl.
CPC ..... *F01P 3/02* (2013.01); *F01P 2003/008* (2013.01); *F01P 2003/021* (2013.01); *F01P 2003/024* (2013.01)

(58) Field of Classification Search
CPC ..... F01P 2003/021; F01P 2003/008; F01P 2003/024; F01P 2003/027–2003/028; F01P 3/02
See application file for complete search history.

(56) References Cited

U.S. PATENT DOCUMENTS

| | | | | |
|---|---|---|---|---|
| 4,440,118 | A | 4/1984 | Stang et al. | |
| 6,101,994 | A * | 8/2000 | Ichikawa | 123/195 R |
| 8,555,825 | B2 | 10/2013 | Lenz et al. | |
| 2002/0100435 | A1 | 8/2002 | Osman | |

FOREIGN PATENT DOCUMENTS

| | | | | |
|---|---|---|---|---|
| GB | 2498782 A | * | 7/2013 | F01P 3/02 |

OTHER PUBLICATIONS

Berkemeier, O. et al., "Innovative Strategien zur interdisziplinären Optimierung des Wärmemanagements von Verbrennungsmotoren: Experimentelle und numerische Methoden zur Entwicklung eines Kühlsystems mit regelbaren Komponenten," Warmemanagement des Kraftfahrzeugs VII, Energiemanagement, Expert Verlag, Renningen, 2005, pp. 186-212, (partial translation of Section 5 on p. 211), 14 pages.

Seider, G. et al., "A High-Resolution Warm-Up Simulation Model for a Gasoline Engine with Advanced Thermal Control," Vehicle Thermal Management Systems Conference and Exhibition, SAE Conference, Gaydon, UK, May 15-19, 2011, 12 pages.

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

Systems are provided to providing water to the bore bridges of a cylinder block that contains an oil cooling system. An oil-cooled cylinder block may be desirable to aid in rapidly increasing engine temperature during engine warm-up, but high local temperatures may exist in the bore bridges in between adjacent cylinders, thereby leading to adverse performance. To control the high local temperatures while maintaining rapid engine warm-up, systems are proposed to provide water coolant from the cylinder head into cross-drilled passages located in the bore bridges of the cylinder block while cooling the rest of the cylinder block with oil or a different coolant.

6 Claims, 5 Drawing Sheets

OIL-COOLED CYLINDER BLOCK WITH WATER-COOLED BRIDGE

FIELD

The present application relates generally to a cylinder block, an attached cylinder head, and cooling passages for providing effective cooling to all parts of the cylinder block and head.

SUMMARY/BACKGROUND

Engine systems often comprise a cylinder block with an attached cylinder head that include a series of cylinders with surrounding material for attaching various components. Cylinder blocks and cylinder heads also include cooling systems that comprise a number of cooling passages that surround the cylinders. A coolant, such as water, oil, glycol, etc., may be pumped or otherwise sent through the cooling passages to remove heat from the cylinders and cylinder block and head via heat exchange. The cooling passages may include inlets and outlets such that coolant at a lower temperature is directed into the cylinder block and head while coolant at a higher temperature is exited from the cylinder block to a heat exchanger or other device. As such, the temperature of the cylinder block and cylinder head may be maintained within a desirable range during engine operation. In some systems, there may be fluidic communication between the cooling passages of the cylinder head and cylinder block. Various cooling systems exist for providing different amounts of cooling to different areas of the cylinder block.

In one approach to provide a cooling system to cool cylinders of an engine, shown by Lenz et al. in U.S. Pat. No. 8,555,825, cooling passages are provided in a cylinder head for receiving coolant from the cylinder block. In one embodiment, coolant is routed out of a cylinder block water jacket via a cooling passage of the cylinder head, along a bridge between two cylinders, and into another cooling passage of the cylinder head to provide cooling to portions proximate to intake and exhaust valves of the cylinders. In other words, coolant is pumped from the cylinder block to the cylinder head, then back into the cylinder block along the bridge in a cooling slot, and finally back into the cylinder head. The cooling slot provides the intermediate connection to allow coolant to flow from the cylinder block into the cylinder head. The fluidic communication between the cylinder head and cylinder block allows coolant located in the cylinder block to flow into the cylinder head proximate to the cylinder and intake/exhaust valves.

However, the inventors herein have identified potential issues with the approach of U.S. Pat. No. 8,555,825. First, while the cooling passages proposed by Lenz et al. allow fluidic communication between the cylinder block and cylinder head, only a single coolant may be routed through the cooling passages. The system does not allow a different degree of cooling to be provided by a different coolant in a particular area of the cylinder block/head assembly. For example, if one portion of the cylinders is desired to be maintained within a certain temperature range while another portion of the cylinders is desired to be maintained within a different temperature range, then two coolants may be directed throughout the assembly. Furthermore, coolant from the coolant jacket surrounding the cylinders may have a high temperature before entering the cooling slot in the bridges as well as the areas proximate to the intake/exhaust valves, thereby decreasing the efficiency of heat removal. Since coolant passing into the cylinder head may be heated by the cylinders first, then a lower amount of heat than desired may be removed from the bridge and cylinder head.

Thus in one example, the above issues may be at least partially addressed by a method, comprising: cooling a cylinder head with a first coolant; cooling a cylinder block with a second coolant, the second coolant a different liquid than the first coolant; and cooling a plurality of bore bridges with the first coolant while maintaining separation between the passages containing the first and second coolants, the plurality of bore bridges in between adjacent cylinders of the cylinder block. In this way, the cylinder head and cylinder block are cooled with separately-maintained cooling systems while a portion of the first coolant (e.g., water) of the cylinder head may aid in cooling certain portions of the cylinder block, in particular the bore bridges.

When a vehicle is first turned on, it may be desirable to rapidly increase the temperature of the engine in order to improve fuel economy. While a water-cooled cylinder block may most effectively remove heat from the engine, a more-than-desired amount of heat may be removed. Alternatively, an oil-cooled cylinder block may remove heat less rapidly than the water-cooled cylinder block, but localized high-temperature regions may exist that adversely affect engine performance. The regions may include the portions in between cylinders known as bore bridges. In some examples, the oil-cooled cylinder block with water-cooled bore bridges may allow the engine to rapidly warm-up while providing sufficient cooling to the bore bridges via the water passages with water from the cylinder head.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
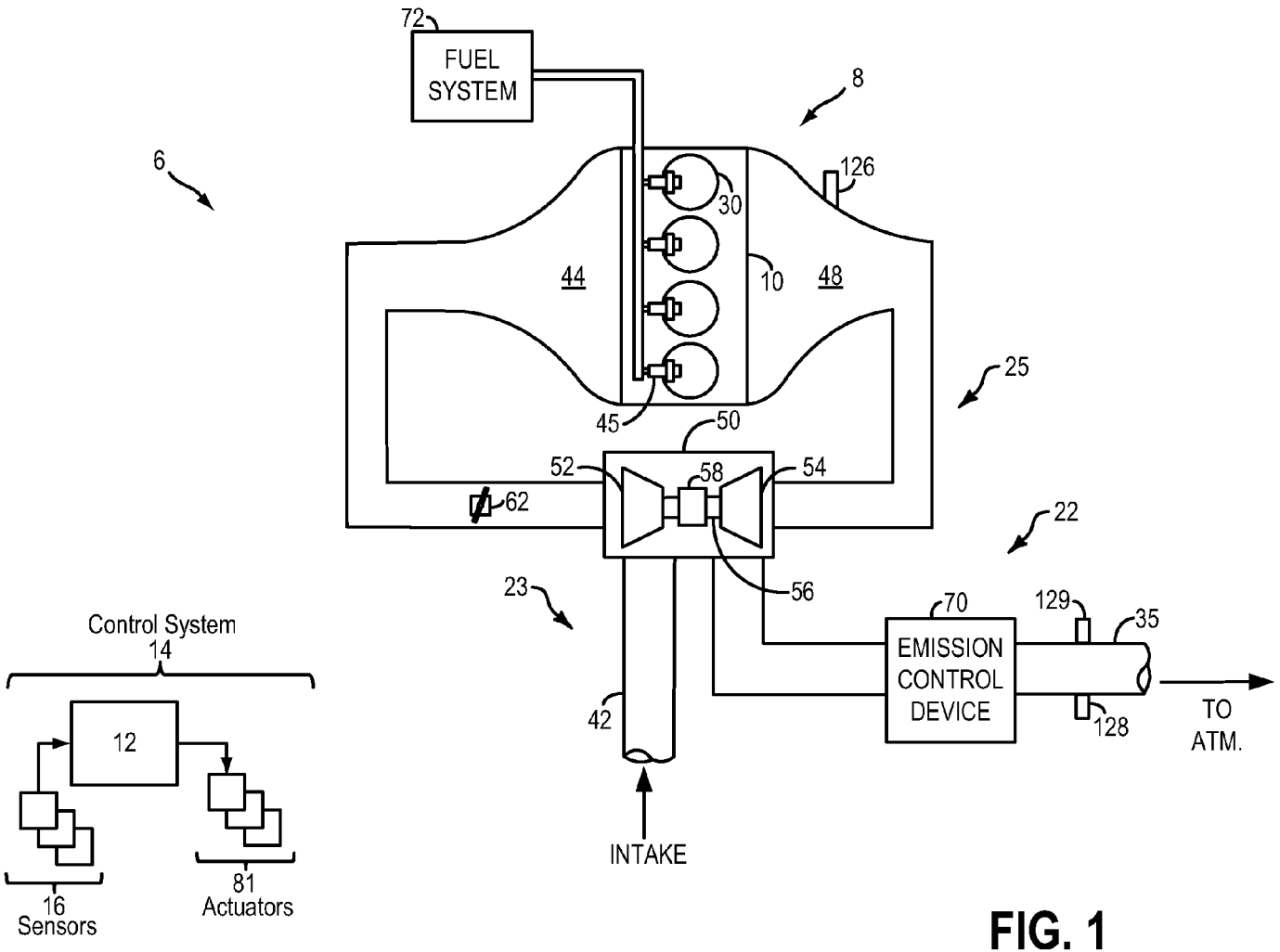
FIG. 1 shows a simplified schematic diagram of a vehicle system.
Figure 2:
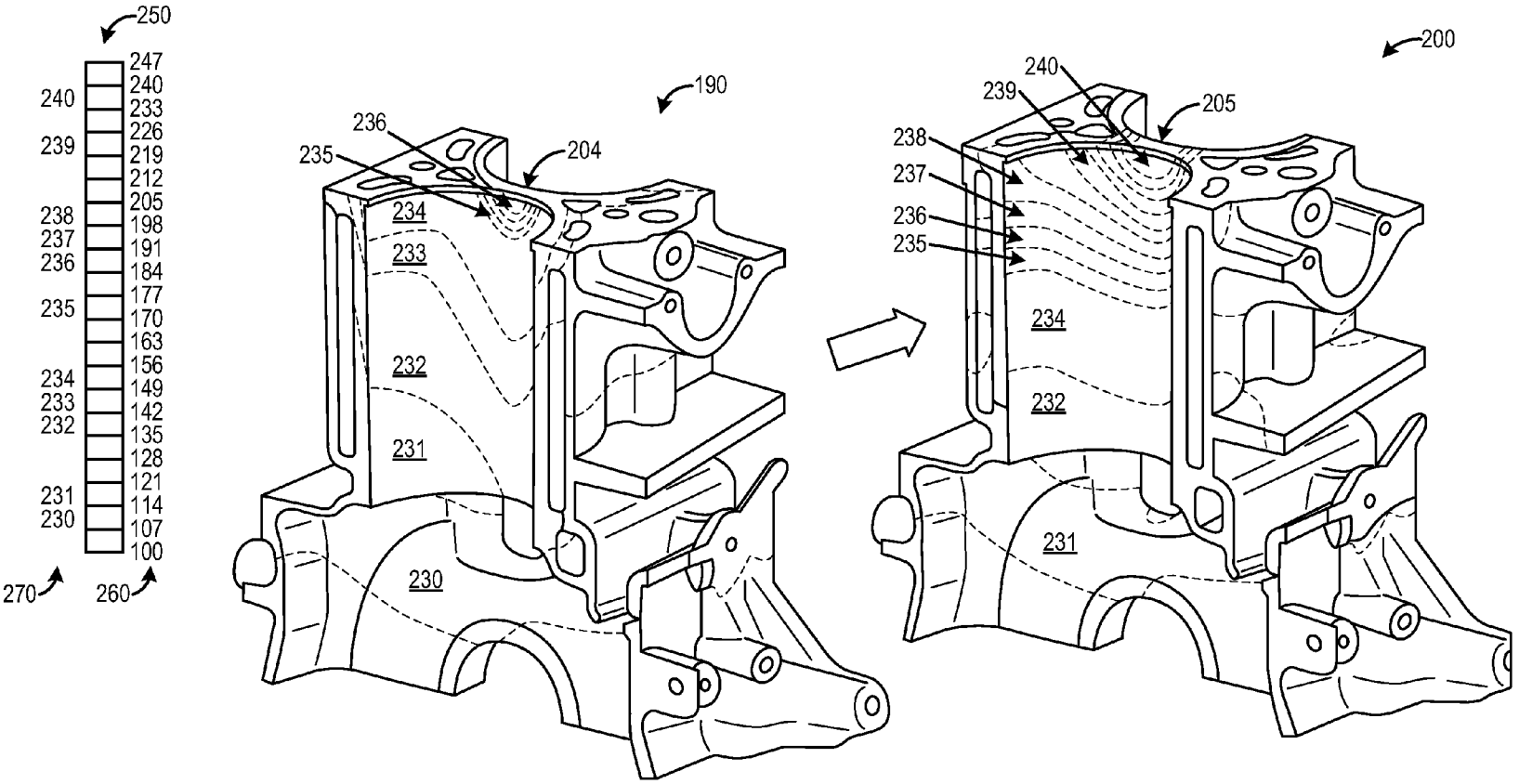
FIG. 2 shows cutaway views of an oil-cooled cylinder block and a water-cooled cylinder block.
Figure 3:
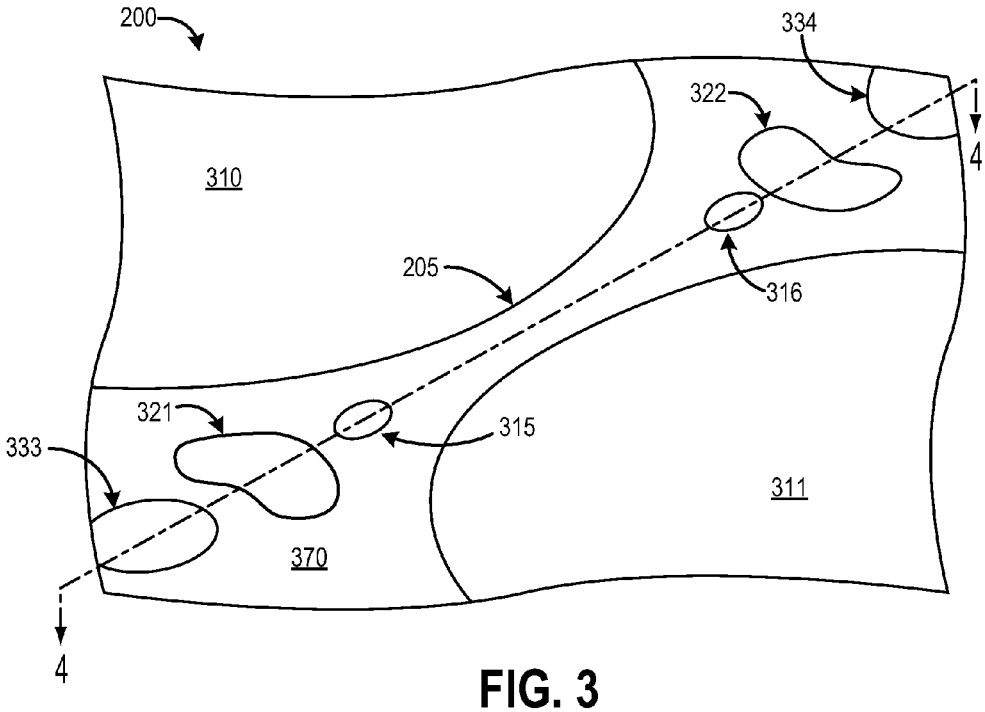
FIG. 3 shows a top perspective view of a bore bridge of a cylinder block with a cross-drilled passage.
Figure 4:
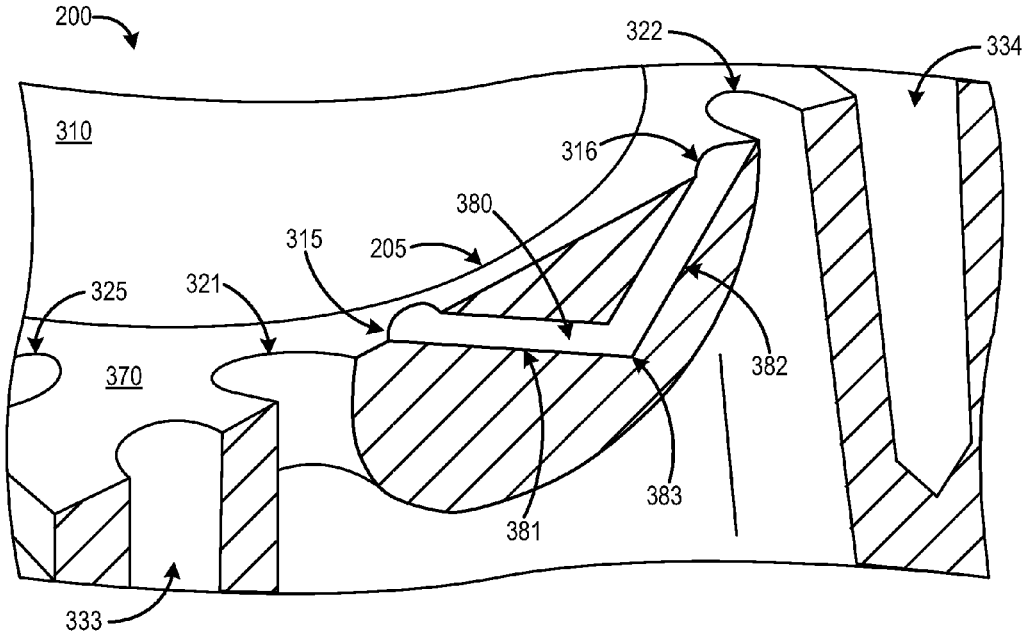
FIG. 4 shows a cross-sectional view of the bore bridge of FIG. 3.
Figure 5:
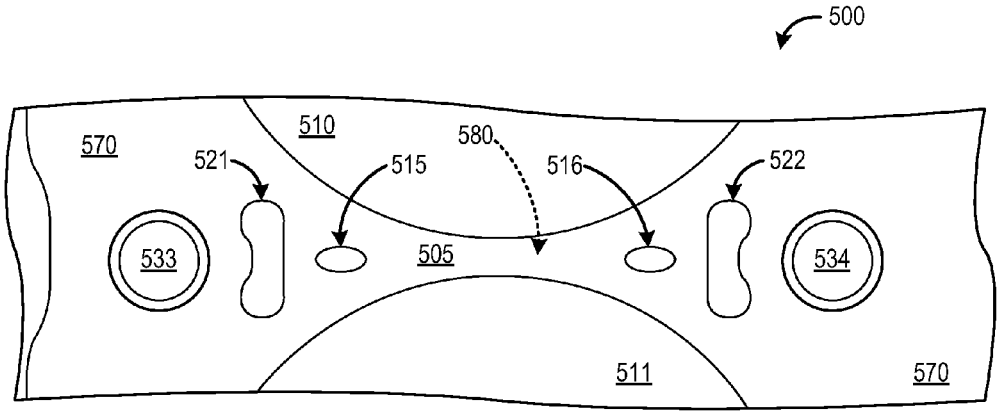
FIG. 5 shows a top view of a cylinder block with a closed deck design.
Figure 6:
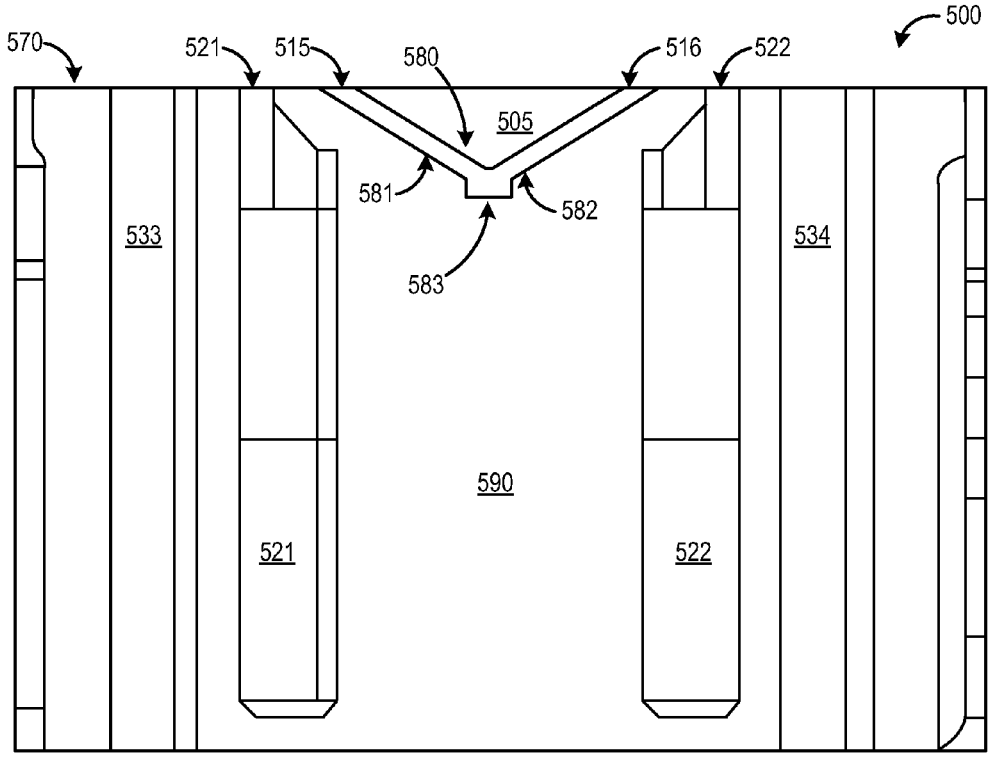
FIG. 6 shows a side view of the cylinder block of FIG. 5.
Figure 7:
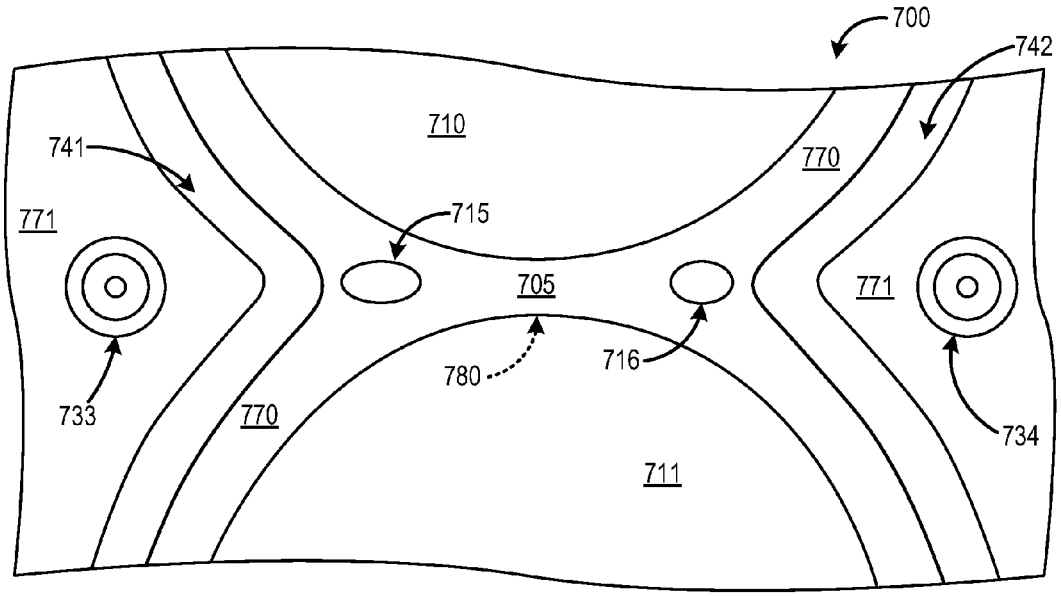
FIG. 7 shows a top view of a cylinder block with an open deck design.
Figure 8:
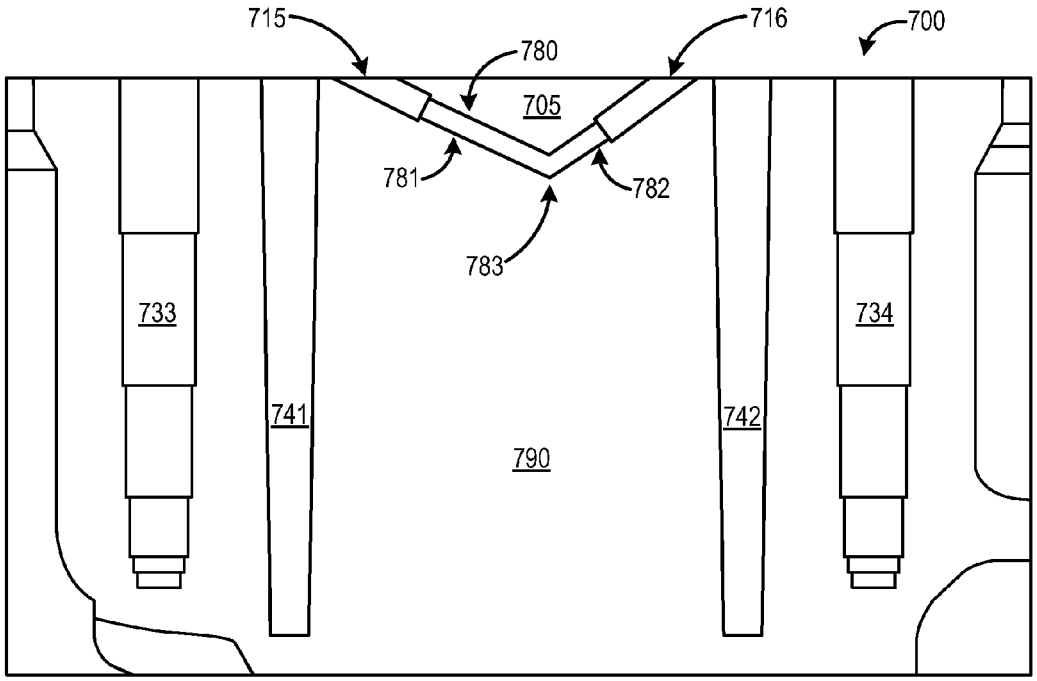
FIG. 8 shows a side view of the cylinder block of FIG. 7.

The following detailed description provides information regarding an oil-cooled cylinder block with a water-cooled cylinder head and their associated components. A simplified schematic diagram of a vehicle system is shown in FIG. 1. FIG. 2 shows an oil-cooled cylinder block and a water-cooled cylinder block with respective temperature gradients showing temperature when the engine is running FIGS. 3 and 4 show a bore bridge of a cylinder block with a cross-drilled passage. FIGS. 5 and 6 show another embodiment of the cross-drilled passage, wherein the cylinder block has a closed deck design. Finally, FIGS. 7 and 8 show yet another embodiment of the cross-drilled passage, wherein the cylinder block has an open deck design.

FIG. 1 shows a schematic depiction of a vehicle system 6 with a turbocharger. The vehicle system 6 includes an engine system 8 coupled to an exhaust after-treatment system 22. The engine system 8 may include an engine 10 having a plurality of cylinders 30. Engine 10 includes an engine intake 23 and an engine exhaust 25. Engine intake 23 includes a throttle 62 fluidly coupled to the engine intake manifold 44 via an intake passage 42. The engine exhaust 25 includes an exhaust manifold 48 eventually leading to an exhaust passage 35 that routes exhaust gas to the atmosphere. Throttle 62 may be located in intake passage 42 downstream of a boosting device, such as turbocharger 50, or a supercharger.

Turbocharger 50 may include a compressor 52, arranged between intake passage 42 and intake manifold 44. Compressor 52 may be at least partially powered by exhaust turbine 54, arranged between exhaust manifold 48 and exhaust passage 35. Compressor 52 may be coupled to exhaust turbine 54 via shaft 56. Compressor 52 may also be at least partially powered by an electric motor 58. In the depicted example, electric motor 58 is shown coupled to shaft 56. However, other suitable configurations of the electric motor may also be possible. In one example, the electric motor 58 may be operated with stored electrical energy from a system battery (not shown) when the battery state of charge is above a charge threshold. By using electric motor 58 to operate turbocharger 50, for example at engine start, an electric boost (e-boost) may be provided to the intake air charge. In this way, the electric motor may provide a motor-assist to operate the boosting device. As such, once the engine has run for a sufficient amount of time (for example, a threshold time), the exhaust gas generated in the exhaust manifold may start to drive exhaust turbine 54. Consequently, the motor-assist of the electric motor may be decreased. That is, during turbocharger operation, the motor-assist provided by the electric motor 58 may be adjusted responsive to the operation of the exhaust turbine.

Engine exhaust 25 may be coupled to exhaust after-treatment system 22 along exhaust passage 35. Exhaust after-treatment system 22 may include one or more emission control devices 70, which may be mounted in a close-coupled position in the exhaust passage 35. One or more emission control devices may include a three-way catalyst, lean NOx filter, SCR catalyst, etc. The catalysts may enable toxic combustion by-products generated in the exhaust, such as NOx species, unburned hydrocarbons, carbon monoxide, etc., to be catalytically converted to less-toxic products before expulsion to the atmosphere. However, the catalytic efficiency of the catalyst may be largely affected temperature by the temperature of the exhaust gas. For example, the reduction of NOx species may require higher temperatures than the oxidation of carbon monoxide. Unwanted side reactions may also occur at lower temperatures, such as the production of ammonia and $N_2O$ species, which may adversely affect the efficiency of exhaust treatment, and degrade the quality of exhaust emissions. Thus, catalytic treatment of exhaust may be delayed until the catalyst(s) have attained a light-off temperature. Additionally, to improve the efficiency of exhaust after-treatment, it may be desirable to expedite the attainment of the catalyst light-off temperature. An engine controller may be configured to inject blow-through air flow into the exhaust after-treatment system, through the cylinders, during an engine cold start, to thereby reduce the light-off time. The air flow, performed during a positive intake to exhaust valve overlap period, may enable fresh blow-through air to be mixed with combusted exhaust gas and generate an exhaust gas mixture in the exhaust manifold. The blow-through air flow may provide additional oxygen for the catalyst's oxidizing reaction. Furthermore, the air flow may pre-clean the extra-rich exhaust from the cold engine, and help bring the catalytic converter quickly up to an operating temperature.

Exhaust after-treatment system 22 may also include hydrocarbon retaining devices, particulate matter retaining devices, and other suitable exhaust after-treatment devices (not shown). It will be appreciated that other components may be included in the engine such as a variety of valves and sensors.

The vehicle system 6 may further include a control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 (located in exhaust manifold 48), temperature sensor 128, and pressure sensor 129 (located downstream of emission control device 70). Other sensors such as pressure, temperature, air/fuel ratio, and composition sensors may be coupled to various locations in the vehicle system 6, as discussed in more detail herein. As another example, the actuators may include fuel injectors 45 (described later), a variety of valves, electric motor 58, and throttle 62. The control system 14 may include a controller 12. The controller may receive input data from the various sensors, process the input data, and trigger the actuators in response to the processed input data, based on instruction or code programmed therein, corresponding to one or more routines. In particular, controller 12 may be a microcomputer, including microprocessor unit, input/output ports, an electronic storage medium for executable programs and calibration values such as a read only memory chip, random access memory, keep alive memory, and a data bus. The storage medium read-only memory can be programmed with computer readable data representing instructions executable by the processor for performing the control methods for different components of FIG. 1.

In some embodiments, each cylinder of engine 10 may be configured with one or more fuel injectors for providing fuel thereto. As a non-limiting example, cylinders 30 are shown including fuel injectors 45 coupled directly to cylinders 30. Fuel injectors 45 may inject fuel directly therein in proportion to a pulse width of a signal received from controller 12 via an electronic driver. In this manner, fuel injectors 45 provide what is known as direct injection (hereafter referred to as "DI") of fuel into combustion cylinder 30. While FIG. 1 shows injectors 45 as side injectors, they may also be located overhead of the cylinders or in other locations in the cylinders 30. Alternatively, the injectors 45 may be located overhead and near intake valves (not shown). Fuel may be delivered to fuel injectors 45 from high pressure fuel system 72 including various components such as a fuel tank, fuel pumps, and a fuel rail. Alternatively, fuel may be delivered by a single stage fuel pump at lower pressure. Further, while not shown, the fuel tank may have a pressure transducer providing a signal to controller 12.

It will be appreciated that in an alternate embodiment, injectors 45 may be port injectors providing fuel into a series of intake ports upstream of cylinders 30 in intake 23. It will also be appreciated that cylinders 30 may receive fuel from a plurality of injectors, such as a plurality of port injectors, a plurality of direct injectors, or a combination thereof.

Engine 10, containing cylinders 30 and other components, may be formed from several large pieces. For example, a top portion of the engine 10 containing camshafts, intake/exhaust ports, and fuel injection components may be contained in a cylinder head that is attached to a separate engine block. The engine block may contain the geometry that defines the shape of cylinders 30 as well as various passages for the cooling system for removing heat from cylinders 30 during engine operation.

With modern vehicles, there is a constant demand for improving fuel economy, which may be achieved by modifying various systems of the vehicle. One way to improve fuel economy is to quickly increase the temperature of the engine after the vehicle is turned on after a period of being off. In other words, by decreasing the time to warm-up the engine, fuel economy may be improved. Fast engine warm-up may help reduce friction and emissions that are commonly higher at engine start-up compared to a fully-warm engine. In this context, engine warm-up may include increasing the temperature of the engine and associated components, including but not limited to, the cylinder block, cylinder head, pistons, cylinders, and intake/exhaust valves.

One way to decrease the warm-up time of the engine is to use oil as the coolant in the cooling passages/jacket of the cylinder block. Due to the properties of oil, an oil-cooled cylinder block may increase in temperature at a higher rate than a water-cooled cylinder block. In other words, oil transfers heat at a lower rate than other coolants such as water or glycol. While the engine may heat up faster with an oil coolant, high local temperatures may occur in the areas in between adjacent cylinders. The higher local temperatures may be high enough to adversely affect engine performance and/or increase the risk of damage to the cylinder block, cylinder head, and other components. As such, an oil-cooled cylinder with a redesign is needed to cool the areas between adjacent cylinders. The areas in between adjacent cylinders are also known as bore bridges, or the top of the bores (cylinders) where common walls are shared between cylinders.

FIG. 2 shows cutaway portions of a water-cooled cylinder block 190 and an oil-cooled cylinder block 200. Cylinder blocks 190 and 200 may be identical in form, with the only difference being the coolant used to remove heat from the cylinders. A temperature scale 250 is shown, with temperature units of degrees Celsius. The temperature scale 250 ranges from approximately 100 to 247 degrees Celsius with increments of 7 degrees, wherein every 7-degree increment is shown as a horizontal line. The temperatures are shown on the right side of scale 250, denoted by arrow 260. The left side of scale shows number labels, as indicated by arrow 270. The number labels 270, ranging from 230 to 240, are also shown in various regions on cylinder blocks 190 and 200. The regions are separated by dashed lines, wherein the dashed lines represented changes in temperature. In this way, cylinder blocks 190 and 200 are superimposed with a temperature gradient plot, wherein the various regions exhibit approximately the temperature represented by the numbered labels. For example, region 231 on cylinder block 190 may exhibit temperatures ranging from approximately 114 to 121 degrees Celsius as can be seen from using scale 250.

Both cylinder blocks 190 and 200 include bore bridges 204 and 205, respectively, which are defined by the upper portion of material located in between adjacent cylinders. In other words, the bore bridges 204 and 205 include material forming the cylinder walls between cylinders of the cylinder blocks 190 and 200, respectively. As seen in FIG. 2, the temperature of bore bridge 205 is significantly higher than the temperature of bore bridge 204. As previously explained, due to the properties of oil, oil removes heat at a slower rate than water or glycol. As such, the localized hot spot around bridge 205 forms. Using temperature scale 250, it can be seen that the temperature of bore bridge 204 ranges from about 170-191° C. with a maximum temperature of 196° C. (not shown). Furthermore, the temperature of bore bridge 205 ranges from about 219-240° C. with a maximum temperature of 245° C. (not shown).

While the other regions of cylinder block 200 remain at lower temperatures similar to the equivalent regions of cylinder block 190, the temperature of cylinder block 200 rapidly increases in the regions surrounding bore bridge 205 and in the bore bridge 205 itself. As a result, bore bridge 205 may exhibit temperatures well in the 200° C. range while bore bridge 204 exhibits temperatures below 200° C. The elevated temperature of bore bridge 205 may lead to abnormal cylinder degradation and adversely affect engine performance. While cylinder block 200 with the oil coolant may heat-up more rapidly during engine warm-up compared to cylinder block 190, the bore bridge 205 may exhibit temperatures outside the range of desired temperatures for optimal engine performance and safety. Without adequate cooling to bore bridge 205, water-cooled cylinder block 190 may be more desirable than oil-cooled cylinder block 200.

The inventors herein have recognized that an oil-cooler cylinder block is feasible while providing adequate cooling to the bore bridges. With a water-cooled cylinder head coupled to an oil-cooled cylinder block, a cross-drilling can be drilled in the bore bridges to allow water from the cylinder head to flow through the bore bridges of the cylinder head while maintaining separation between the cooling passages of the cylinder head and cylinder block. With this configuration, the rapid warm-up properties of the oil-cooled cylinder block may be achieved while controlling the temperature of the bore bridges within a desired range with water from the cylinder head. The embodiments of an oil-cooled cylinder block, water-cooled cylinder head, bore bridge, and coolant passages described hereafter may be modified while still providing oil and water cooling to the cylinder block, wherein the oil and water do not mix.

FIG. 3 shows a perspective view of the top of two adjacent cylinders located in an oil-cooled cylinder block 200. A first cylinder 310 is shown adjacent to a second cylinder 311, separated by a bore bridge 205. A top surface 370 (or deck) of the cylinder block 200 defines a generally planar surface that may contact a bottom surface of a cylinder head when the cylinder block 200 and cylinder head are attached. The cylinder head is not shown in FIG. 3. Fastener holes 333 and 334 can be seen that comprise generally circular shapes. The fastener holes 333 and 334 may be threaded or otherwise formed to allow fasteners to be inserted into the holes when the cylinder block 200 and cylinder head are attached. The entrances of several oil cooling passages 321 and 322 can be seen in FIG. 3, which may be part of the coolant (oil) passage system of cylinder block 200. Oil may be pumped through passages 321 and 322 as well as others (not visible in FIG. 3) to provide cooling to the cylinders of cylinder block 200, such as cylinders 310 and 311. Passages 321 and 322 may be fluidically coupled to other passages within cylinder block 200 as part of a larger cooling system.

The bore bridge 205 contains a cross-drilled passage (not visible) with an inlet 315 and an outlet 316, which are symmetrical about a section line 4-4. Water, or other coolant such as glycol different from the oil coolant of cylinder block 200, may generally flow into inlet 315, through the cross-drilled passage, and exit from outlet 316. In this way, the oil passages 321 and 322 do not connect to the cylinder head and the water cooling passage of the cylinder head traverses the bore bridge 205 via the cross-drilled passage. The shape of the cross-drilled passage is explained in further detail in FIG. 4, where the cross-drilled passage is clearly visible. As seen in FIG. 3, the inlet 315 and outlet 316 are completely located on the same plane as top surface 370. It is understood that other positions of inlet 315 and outlet 316 are possible while remaining within the scope of the present disclosure. For example, inlet 315 may also be located in a different area on bore bridge 205 while still remaining on top surface 370. In another example, inlet 315 and outlet 316 may be skewed such that the line of section line 4-4 does not pass through the centers of the inlet and outlet. Furthermore, the inlet and outlet may be the same size or different sizes and comprise the same or different shapes.

FIG. 4 shows a sectional view of cylinder block 200 of FIG. 3, taken along section line 4-4 of FIG. 3. The view of FIG. 4 is substantially the same as the top perspective view of FIG. 3, with first cylinder 310 visible while second cylinder 311 is removed due to the section along line 4-4. As seen in FIG. 4, the cross-drilled passage 380 includes an inlet passage 381 and an outlet passage 382 that fluidically join at an apex 383 within the bore bridge 205. The inlet passage 381 and outlet passage 382 protrude into the bore bridge 205 at angles from the top surface 370. The apex 383 is the geometrical point at which the inlet passage 381 and outlet passage 382 meet. As explained in further detail below, the angles at which the passages protrude into the bore bridge 205 from the top surface may vary. With the sectional view of FIG. 4, the tapped fastener holes 333 and 334 are seen to extend into cylinder block 200. Furthermore, oil cooling passages 321 and 322 extend into the interior of cylinder block 200. Water or other coolant from the cylinder head (not shown) may be provided to cross-drilled passage 380 while remaining separate from the oil or other coolant of cylinder block 200. In this way, the cross-drilled passage 380 may be fluidically separated from the oil cooling passages of cylinder block 200, such as passages 321 and 322. The water cooling passage of the cylinder head may pass into the cylinder block 200 via cross-drilled passage 380 and exit back into the cylinder head without mixing with the oil of passages such as passages 321 and 322.

It is noted that while only two cylinders 310 and 311 are shown in FIGS. 3 and 4, it is understood that cross-drilled passages similar to passage 380 may be located in the bore bridges of additional cylinders in the same cylinder block. In particular, the oil-cooled cylinder block 200 may further comprise additional cylinders with bore bridges positioned between the additional cylinders, and wherein the water cooling passages of the cylinder head also traverse every bore bridge. In this way, the cross-drilled passage and cooling the bore bridges of the oil-cooled cylinder block with water from the water-cooled cylinder head may be applied to a variety of engine configurations. A plurality of bore bridges and cross-drilled passages may be interspersed between a plurality of cylinders of a single cylinder block that is removably attached to a single cylinder head. In the same sense, the oil-cooled cylinder block 200 may further include additional oil cooling passages that are fluidically separated from the water cooling passage and do not connect to the cylinder head.

The geometry of cylinder blocks may generally fall into one of two categories: open and closed deck designs. Open deck cylinder blocks maintain a clearance between the material of the cylinder bores and outer walls of the cylinder block throughout the majority of the circumferences of the cylinders. In open deck designs, multiple clearances or gaps may be present throughout the cylinder block, where the gaps may be used as cooling passages or jackets that aid in removing heat generated during the combustion process. In many open deck designs, the only material connecting adjacent cylinders and the outer walls of the cylinder block is located in the bore bridges, such as bridge 205 of FIGS. 3 and 4. Closed deck cylinder blocks contain more material than open deck designs to provide connection between the cylinders and outer walls of the cylinder block. While clearances or gaps still exist in closed deck designs, the clearances may be smaller and located more further apart than the clearances of open deck designs. Furthermore, the degree of openness of the cylinder deck is often a qualitative measure that varies between manufacturers. For example, some cylinder blocks may be classified as having semi-closed decks when the decks are not fully open or fully closed. The difference between open and closed deck cylinders in the context of the present disclosure can be more clearly seen in FIGS. 5-8, explained below.

FIG. 5 shows a top view of a closed deck cylinder block 500 containing a cross-drilled passage 580 (not completely visible in FIG. 5). In particular, cross-drilled passage 580 is located in bore bridge 505, the material joining cylinders 510 and 511 located adjacent to the cylinder walls. Similar to the items shown in FIG. 4, cross-drilled passage 580 includes an inlet 515 and an outlet 516 for flowing coolant through the passage 580. The closed deck aspect of cylinder block 500 is shown by the prevalence of top surface 570, which is solid material. There are no large, continuous open spaces that separate cylinders 510 and 511 from the rest of the cylinder block 500. Furthermore, a number of oil passages 521 and 522 are visible between adjacent cylinders 510 and 511. Fastener holes 533 and 534 may be tapped or otherwise threaded to receive bolts or other fasteners to hold cylinder block 500 to its corresponding cylinder head (not shown). Features including inlet 515, outlet 516, fastener holes 533 and 534, and oil passages 521 and 522 lie along a generally planar surface defined by top surface 570 of cylinder block 500. Top surface 570 may also be referred to as the deck of the cylinder block. As seen in FIG. 5, the majority of top surface 570 is solid material surrounding cylinders 510 and 511, thereby forming a closed deck cylinder block, as described above. The separation between inlet 515 and passage 521 as well as between outlet 516 and passage 522 is clearly seen in FIG. 5. As such, the water or first coolant may be maintained separately from the oil or second coolant.

FIG. 6 shows a side cross-sectional view of the closed deck cylinder block 500 of FIG. 5. As seen, cross-drilled passage 580 includes an inlet passage 581 leading from inlet 515 to an apex 583 (meeting point). Also, passage 580 includes an outlet passage 582 that leads from apex 583 to outlet 516 at top surface 570. When the first coolant is pumped or otherwise forced through inlet 515 and out outlet 516, heat from bore bridge 505 may be transferred via heat exchange to the first coolant which again transfers the heat downstream and outside the cylinder block 500 and cylinder head (not shown). In this way, while the second coolant is circulated through passages 521 and 522 to allow the cylinders to heat up quicker during engine warm-up, the first coolant passing through cross-drilled passage 580 can remove heat from bore bridge 505 at a faster rate than the second coolant. While heat may be more rapidly removed from bore bridge 505, heat may be removed at a lower rate farther away from cross-drilled passage 580, such as in cylinder wall 590 located in between oil-cooled passages 521 and 522. Cylinder wall 590 provides the material that separates cylinders 510 and 511.

Apex 583 has a different shape than apex 383 of FIG. 3, serving as an example of how the cross-drilled passage may vary in shape and size depending on design factors such as cylinder spacing, bore bridge size, and inlet/outlet positioning. In one example, the water cooling passage (i.e., cross-drilled passage 580) traversing the bore bridge 505 includes a generally linear inlet passage 581 and a generally linear outlet passage 582, and wherein the inlet and outlet passages connect inside the cylinder block at apex 583. In another example, the water cooling passage traversing the bore bridge 505 is generally curved from where the passage enters the oil-cooled cylinder block 500 to where the passage exits the oil-cooled cylinder block. Other shapes are possible while pertaining to the scope of the present disclosure.

Furthermore, from the side view of FIG. 6, it can be seen that inlet passage 581 and outlet passage 582 are substantially the same length. As such, the angle at which inlet passage 581 protrudes into bore bridge 505 is the same as the angle at which outlet passage 582 protrudes into the bore bridge. For example, the angle may be 45 degrees as measured from top surface 570 to the axes defined by the lengths of passages 581 and 582. In other words, generally, the water cooling passage of the cylinder head traversing the bore bridge 505 via cross-drilled passage 580 protrudes into the oil-cooled cylinder block 500 at a first angle greater than 0 and exits from the oil-cooled cylinder block at a second angle greater than 0. It is understood that the lengths, angles, and shapes of inlet passage 581 and outlet passage 582 may be different. For example, the inlet passage 581 and outlet passage 582 may intersect top surface 570 at different angles.

FIG. 7 shows a top view of an open deck cylinder block 700 containing a cross-drilled passage 780 (not completely visible in FIG. 7). Passage 780 includes an inlet 715 and an outlet 716 for circulating the first coolant through bore bridge 705. Cylinder block 700 includes a number of cylinders 710 and 711 and a number of oil passages 741 and 742. While only two cylinders are shown in FIG. 7, it is understood that more cylinders may be included in cylinder block 700. As compared to the oil passages of FIGS. 5 and 7, oil passages 741 and 742 generally follow and extend around the circumference of cylinders 710 and 711. Cylinder block 700 also includes a first top surface 770 that lies adjacent to cylinders 710 and 711 while a second top surface 711 surrounds the first top surface. As seen in FIG. 7, the first and second top surfaces are separated by oil passages 741 and 742. The large, continuous shapes of passages 741 and 742 surrounding cylinders 710 and 711 defines the open deck aspect of cylinder block 700. While not shown in FIG. 7, there may be portions that connect top surfaces 770 and 771, but compared to the closed deck design, the top surfaces of the open deck design remain separated throughout a majority of the cylinder block 700. Fastener holes 733 and 734 are provided in second top surface 771 and bore bridge 705 is located in first top surface 770. It is noted that the water cooling passage (or first cooling passage) of the cylinder head (not shown) fluidically couples with inlet 715 and outlet 716 when the cylinder head is attached to the cylinder block 700.

FIG. 8 shows a side cross-sectional view of the open deck cylinder block 700 of FIG. 7. As seen, cross-drilled passage 780 includes an inlet passage 781 and outlet passage 782, similar to the inlet/outlet passages described in previous figures. Passages 780 and 781 contain multiple sections that have different diameters, whereas passages 580 and 581 share substantially the same diameter, for example. Oil passages 741 and 742 may generally follow an outer circumference of cylinders 710 and 711 as defined by top surface 770. Fastener holes 733 and 734 are also visible along with cylinder wall 790. Cylinder wall 790 may define the portion of material separating cylinder 710 and 711, the top of which is referred to as the bore bridge 705. Furthermore, as compared to cylinder block 500 of FIGS. 5 and 6, cylinder wall 790 may contain less material than cylinder wall 590 since cylinder block 700 is an open deck design while cylinder block 500 is a closed deck design.

A method for cooling the systems shown in FIGS. 2-8 may comprise cooling a cylinder head with a first coolant, cooling a cylinder block with a second coolant, the second coolant a different liquid than the first coolant, and cooling a plurality of bore bridges with the first coolant while maintaining separation between the passages containing the first and second coolants, the plurality of bore bridges in between adjacent cylinders of the cylinder block. In some examples, the first coolant is water while the second coolant is oil or a suitable coolant that removes heat at a lower rate than the first coolant. Cooling the plurality of bore bridges may include circulating the first coolant through passages contained in each of the bore bridges. Furthermore, cooling the cylinder head and cylinder block may include circulating the first and second coolants through the cylinder head and cylinder block, respectively. It is understood that the first and second coolants do not mix as the first and second coolants circulate through the cylinder head and cylinder block. To provide efficient cooling, temperatures of the first and second coolants are reduced in one or more heat exchangers positioned outside the cylinder head and cylinder block.

In this way, by providing the cross-drilled passages in the bore bridges of either the open or closed deck cylinder blocks, the temperature ranges (i.e., local temperatures) of bore bridges in between adjacent cylinders may be controlled while allowing the rest of the cylinders to quickly heat during engine warm-up. Furthermore, the addition of the cross-drilled passages may not require readjusting bore spacing, that is, the thickness of the bore bridges in between each cylinder. As such, major redesign of existing cylinder blocks may be unnecessary, thereby reducing costs associated with the aforementioned cross-drilled passages. By allowing the engine to warm up more rapidly compared to water-cooled cylinder blocks, friction and emissions may be reduced with the proposed oil-cooled cylinder block to increase fuel economy and engine efficiency. Additionally, with the separately-cooled cylinder head and cylinder block, the cooling systems associated with the first and second coolants may be controlled independently or in conjunction with each other.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a cylinder head with a water cooling passage; and an oil-cooled cylinder block coupled to the cylinder head and having an oil passage that does not fluidly connect to the cylinder head, the water cooling passage traversing a bore bridge positioned between a first cylinder and a second cylinder and passing into the cylinder block and then back into the cylinder head, the water cooling passage including an inlet and an outlet located along a surface of the oil-cooled cylinder block, the inlet and outlet positioned between oil passages located along the surface, the surface contacting the cylinder head.

2. The system of claim 1, wherein the oil-cooled cylinder block further comprises additional cylinders with bore bridges positioned between the additional cylinders, and wherein the water cooling passages also traverse every bore bridge, and where the surface is comprised of a first surface and a second surface, the second surface surrounding the oil passages.

3. The system of claim 1, wherein the water cooling passage traversing the bore bridge protrudes into the oil-cooled cylinder block at a first angle greater than 0 relative to the surface and exits from the oil-cooled cylinder block at a second angle greater than 0 relative to the surface.

4. The system of claim 3, wherein the water cooling passage traversing the bore bridge includes a generally linear inlet passage and a generally linear outlet passage, and wherein the inlet and outlet passages connect inside the cylinder block at an apex.

5. The system of claim 3, wherein the water cooling passage traversing the bore bridge is generally curved from where the passage enters the oil-cooled cylinder block to where the passage exits the oil-cooled cylinder block.

6. The system of claim 1, wherein the oil-cooled cylinder block further includes additional oil cooling passages that are fluidically separated from the water cooling passage and do not connect to the cylinder head.

* * * * *